US005091617A

United States Patent [19]

Maehara et al.

[11] Patent Number: 5,091,617

[45] Date of Patent: Feb. 25, 1992

[54] HIGH FREQUENCY HEATING APPARATUS USING INVERTER-TYPE POWER SUPPLY

[75] Inventors: Naoyoshi Maehara; Takahiro Matsumoto, both of Nara; Kazuho Sakamoto, Kyoto; Daisuke Bessyo, Yamatokoriyama; Takashi Niwa, Nara; Shigeru Kusunoki; Takao Shitaya, both of Yamatokoriyama, all of Japan

[73] Assignee: Matsushita Electric Industrial Co., Ltd., Kadoma, Japan

[21] Appl. No.: 526,521

[22] Filed: May 22, 1990

Related U.S. Application Data

[63] Continuation of Ser. No. 147,946, Jan. 25, 1988, abandoned.

[30] Foreign Application Priority Data

Jan. 26, 1987 [JP] Japan ..... 61-15509

[51] Int. Cl.[5] ..... H05B 6/68

[52] U.S. Cl. ..... 219/10.55 B

[58] Field of Search ..... 219/10.55 B, 10.55 R, 219/10.77; 315/39.51, 105, 106, 85, 107, DIG. 2, DIG. 5, DIG. 7; 331/86-90; 363/37, 49, 95; 328/75, 267, 270

[56] References Cited

U.S. PATENT DOCUMENTS

| | | | |
|---|---|---|---|
| 4,002,875 | 1/1977 | Kiuchi et al. | 219/10.55 B |
| 4,076,996 | 2/1978 | Maehara et al. | 315/106 |
| 4,156,829 | 5/1979 | Harada | 315/39.51 |
| 4,164,685 | 8/1979 | Takahashi | 315/105 |
| 4,318,165 | 3/1982 | Kornrumpf et al. | 363/21 |
| 4,383,156 | 5/1983 | Furusawa | 219/10.55 B |
| 4,467,165 | 8/1984 | Kiuchi et al. | 219/10.77 |
| 4,620,078 | 10/1986 | Smith | 219/10.55 B |
| 4,663,508 | 5/1987 | Ishimura et al. | 219/10.55 B |
| 4,704,674 | 11/1987 | Maehara et al. | 363/131 |
| 4,705,926 | 11/1987 | Sakai et al. | 219/10.55 B |
| 4,724,291 | 2/1988 | Inumada et al. | 219/10.55 B |
| 4,825,028 | 4/1989 | Smith | 219/10.55 B |
| 4,851,629 | 7/1989 | Bessyo et al. | 219/10.55 B |

FOREIGN PATENT DOCUMENTS

| | | |
|---|---|---|
| 79342 | 11/1977 | Japan . |
| 94547 | 12/1977 | Japan . |
| 103739 | 12/1977 | Japan . |
| 115446 | 1/1978 | Japan . |
| 41842 | 6/1978 | Japan . |
| 75546 | 9/1978 | Japan . |
| 110142 | 11/1978 | Japan . |

*Primary Examiner*—A. D. Pellinen
*Assistant Examiner*—David Osborn
*Attorney, Agent, or Firm*—Spencer & Frank

[57] ABSTRACT

A high-frequency heating apparatus comprises an inverter including a semiconductor switch and a resonance capacitor, a boosting transformer for a supplying high-voltage power and heater to a magnetron an inductance device inserted in the heater circuit of the magnetron, and an inverter control unit for controlling the semiconductor switch. The inverter control unit is controlled by a start control at the start time of the inverter so that the conduction time of the semiconductor switch becomes shorter than that under a normal operating condition and the non-conduction time thereof becomes longer than that under a normal operating condition and so that the switching period of the semiconductor switch becomes substantially an integral multiple of a resonance period of the resonance circuit formed by the resonance capacitor, whereby the operating frequency of the inverter at the time of starting thereof becomes substantially equal to its normal operating frequency.

8 Claims, 11 Drawing Sheets

HIGH FREQUENCY HEATING APPARATUS USING INVERTER-TYPE POWER SUPPLY

This application is a continuation of application Ser. No. 07/147,946, filed Jan. 25th, 1988, abandoned.

BACKGROUND OF THE INVENTION

1. Field of the Invention

The present invention relates to an improved high-frequency heating apparatus such as a microwave oven for heating foods or liquids by what is called dielectric heating, or in particular, to an improved high-frequency heating apparatus comprising an inverter using a semiconductor switch such as a transistor for generating high-frequency power to supply high-voltage power and heater power to a magnetron.

2. Description of the Related Art

High-frequency heating apparatuses of the above-mentioned type have so far been suggested in various configurations for reducing the size, weight and cost of a power transformer used therewith.

FIG. 1 is a circuit diagram of a conventional high-frequency heating apparatus.

In FIG. 1, a commercial power supply 1, a diode bridge 2 and a capacitor 3 make up a power supply 5 of an inverter 4. The inverter 4, in turn, includes a reset inductor 6, a thyristor 7, a diode 8 and a resonance capacitor 9. The thyristor 7 is adapted to be triggered at a predetermined frequency $f_0$ by an inverter control circuit 10, with the result that an inverter of the relaxation oscillation type made up of the reset inductor 6 and a series resonance circuit including the primary winding 12 of a boosting transformer 11 and the resonance capacitor 9 is energized at the operating frequency $f_0$ thereby generating high-voltage power $P_0$ and heater power $P_H$ respectively in the high-voltage secondary winding 13 of the boosting transformer 11 and the heater winding 14. The high-voltage power $P_0$ generated in the high-voltage secondary winding 13 is rectified by high-voltage diodes 15, 16 and capacitors 17, 18 and supplied to a magnetron 19. Also, the heater winding 14 makes up a resonance circuit with a capacitor 20, through which the heater power $P_H$ is supplied to the cathode heater of the magnetron 19. Numeral 21 designates a start control circuit for controlling the inverter control circuit 10 for a predetermined time during starting of the inverter 4 thereby reducing the trigger frequency $f_0$ thereof. This operation is in order to keep low the on-load voltage generated in the high-voltage secondary winding 13 before the cathode of the magnetron 19 is heated at the start time.

FIG. 2 is a diagram showing changes in the high-voltage power $P_0$, the heater power $P_H$ and the anode voltage $V_{AKO}$ of the magnetron 19 under no load at the operating frequency $f_0$ of the inverter 4. When $f_0$ is a predetermined steady frequency $f_{01}$, $P_0$ and $P_H$ assume respective rated values of 1 KW and 40 W. When the inverter 4 is started with $f_0$ for starting the apparatus, the no-load anode voltage $V_{AKO}$ reaches a value as high as 20 KV or more, thereby making difficult the treatment for dielectric strength both technically and in respect of the production cost. For this reason, the inverter control circuit 10 is controlled by a start control circuit 21 in a manner to reduce $f_0$ to $f_{0S}$ for a predetermined length of time during starting. When $f_0$ is equal to $f_{0S}$, it is possible to reduce $V_{AKO}$ to a value lower than 10 KV. The value of $P_H$, on the other hand, is not reduced greatly but to about 30 W due to the resonance effect of the capacitor 20 included in the heater circuit. As a result, although there is a longer time required before complete heating of the cathode than when the rating of $P_H$=40 W is involved, there is no abnormally high $V_{AKO}$ generated in starting the high frequency heating apparatus.

FIGS. 3A, 3B and 3C are diagrams showing the manner in which the operating frequency $f_0$, the anode voltage $V_{AK}$ of the magnetron and the anode current $I_A$ of this high-frequency heating apparatus undergo a change during the starting process.

As shown in FIG. 3A, the inverter control circuit 10 is controlled by the start control circuit 21 in such a way that $f_0$ is controlled to $f_{0S}$ during the period of time from $t=0$ to $t=t'_1$ after which $f_0=f_{01}$ holds at time $t_2$. As a result, as shown in FIG. 3B, the voltage $V_{AK}$ is regulated as $V_{AKOmax}<10$ KV, and as shown in FIG. 3C, the anode current $I_A$ starts and reaches $I_{Al}$ during the time between $t_1$ and $t_2$ thereby producing a rated high voltage output $P_0$=1 KW. Specifically, this apparatus is so configured that after the transient period of the region B through a preheating period of the region A, the steady state of the region C is reached.

In this way, the frequency $f_0$ is reduced to $f_{0S}$ at the time of starting in a manner compatible with the resonance of the capacitor 20 in the heater circuit, thereby preventing an abnormal high voltage from being generated at the time of first starting. It is thus possible to realize a high-frequency heating apparatus that can be started stably.

This conventional high-frequency heating apparatus, however, has the disadvantages mentioned below.

The heater power $P_H$ is supplied from a heating winding 14 wound on the same core as the high-voltage secondary winding 13 for producing a high voltage power $P_0$. Therefore, as shown in FIG. 2, it is difficult to maintain $P_H$ constant against the frequency $f_0$, and even with the provision of a resonance capacitor 20, what can be expected is not more than preventing the value $P_H$ from changing in proportion to $P_0$, thus attaining at most the characteristic shown by the dashed curve. Specifically, it is impossible to realize more than attaining a $P_H$ of 30 W when $f_0$ is reduced to $f_{0S}$.

FIG. 4 is a diagram showing an example of the relationship between the heater power $P_H$ and the time before start of oscillation of the magnetron after the heater power $P_H$ is supplied to heat the cathode sufficiently, that is, the oscillation start time $t_s$. As seen from this diagram, in the prior art, it is possible to prevent generation of an abnormally high voltage but it is difficult to supply sufficient heater power $P_H$ during the starting process, so that the oscillation start time $t_s$ is increased to several times longer than when the rated $P_H$ (=40 W) is supplied.

Specifically, the region A shown in FIG. 3C is lengthened, with the result that an application of the prior art circuit to a high-frequency heating apparatus, such as a microwave oven featuring quick cooking in the order of seconds, would unavoidably lead to a reduced material function.

In FIG. 5A, the period of time t from $t_1$ to $t_2$ is one where the heater power $P_H$ is gradually increased while the high-voltage power $P_0$ to the magnetron (that is, the anode current $I_A$) is increased in the manner shown in FIG. 5C.

FIGS. 5A, 5B and 5C are diagrams showing a relationship in which the heater power $P_H$, cathode temperature $T_C$ and high-voltage power $P_0$ increase with the increase in $f_0$ from $f_{0S}$ to $f_{01}$. As obvious from these diagrams, the cathode temperature $T_C$ which has a predetermined thermal time constant is delayed by $\tau$ behind the increase in $P_H$, and reaches a rated temperature when t is $t_3$. The power $P_0$, on the other hand, increases at the same time as $P_H$, and therefore the period involved, that is, from $t_1$ to $t_3$ is one in which the cathode is liable to exhibit a phenomenon wherein it is be short of emission or the like. The fact that this region is long results in a very significant disadvantage in that the service life of the cathode of the magnetron is greatly reduced.

Further, to configure a resonance circuit including a capacitor 20 in the heater circuit of the magnetron 19 is very inconvenient in view of the small cathode impedance and the high potential thereof.

SUMMARY OF THE INVENTION

The present invention has been developed in order to solve the above-mentioned problems of the prior art and the object thereof is to provide a high-frequency heating apparatus comprising a power supply such as a commercial power supply, an inverter including one or more semiconductor switches and a resonance capacitor, a boosting transformer forming a resonance circuit with this resonance capacitor for supplying a high voltage and heater power to the magnetron, inductance means connected in series with the cathode of the magnetron, inverter control means for controlling the conduction time or the like of the semiconductor switch, and start control means for applying a modulation command to the inverter control means when starting the inverter, wherein the inverter control means is so configured that the conduction time of the semiconductor switch is lower than under a normal condition and the non-conduction time thereof is made longer than under a normal condition the modulation command, while at the same time controlling the non-conduction time of the semiconductor switch to have a length substantially equal to an integral multiple of the resonance period of the resonance circuit, thereby controlling the operation period of the inverter to a length substantially equal to or longer than the one under a normal condition.

The present invention having a configuration described above has the effects and functions described below.

At the time of starting the inverter, a modulation command signal of a start control means is applied to inverter control means, which reduces the conduction time of a semiconductor switch to a length shorter than the conduction time under a normal condition, while at the same time increasing the non-conduction time of the semiconductor switch to a length longer than the normal non-conduction time, and that, to a value in proximity to an integral multiple of the resonance period of the resonance circuit, thereby rendering the operation period of the inverter equal to or longer than the normal period.

Since the conduction time of the semiconductor is reduced, the output voltage of the boosting transformer is kept low so that both the high output voltage and the heater output voltage are controlled at a low level. At the same time, the non-conduction time is prevented from being increased thereby preventing the operation cycle from being shortened and is controlled at a period equal to or longer than the one for a normal operation. As a result, the impedance of the inductance means arranged in series with the cathode of the magnetron is prevented from increasing, and therefore the current flowing in the cathode is controlled at a proper value equal to or larger than the one for a normal operation.

Further, since the non-conduction time is controlled substantially at an integral multiple of the resonance period of the resonance circuit, the terminal voltage for conducting the semiconductor switch takes almost a minimum value. The switching loss of the semiconductor switch is thus reduced greatly while realizing the modulation control for the starting operation mentioned above. As a consequence, the loss of the semiconductor switch is reduced thereby preventing an abnormally high voltage from being generated at the time of starting on the one hand, and the heater power is controlled at a proper value equal to or larger than the one for a normal operation on the other hand.

DESCRIPTION OF THE PREFERRED EMBODIMENT

An embodiment of the present invention will be explained below with reference to the accompanying drawings.

Figure 1:
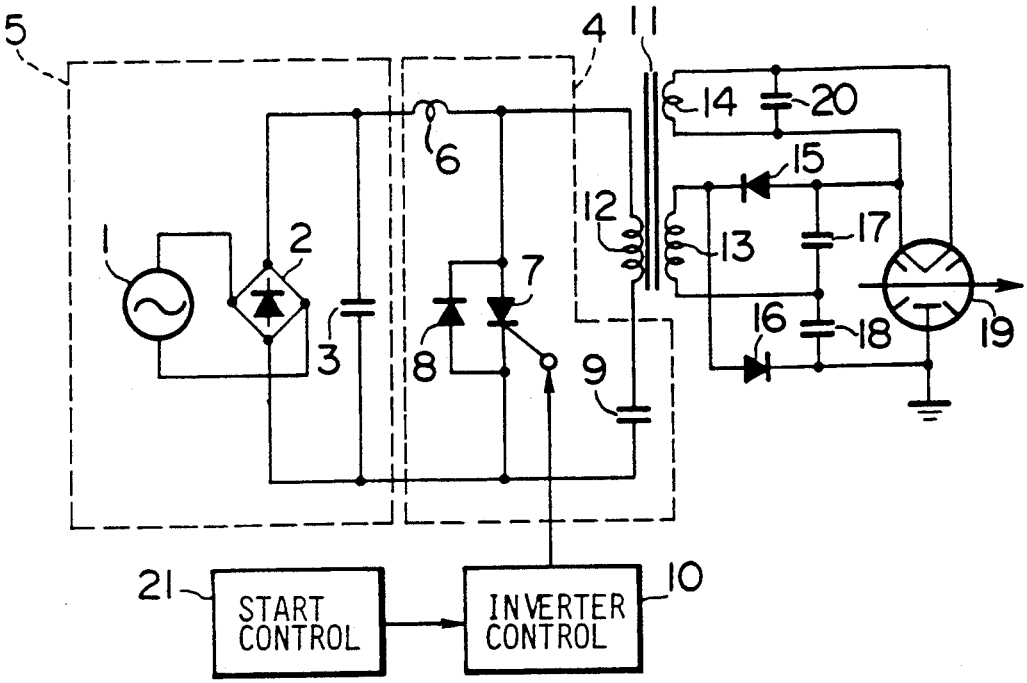
FIG. 1 PRIOR ART
FIG. 1 is a diagram showing a prior art circuit.
Figure 2:
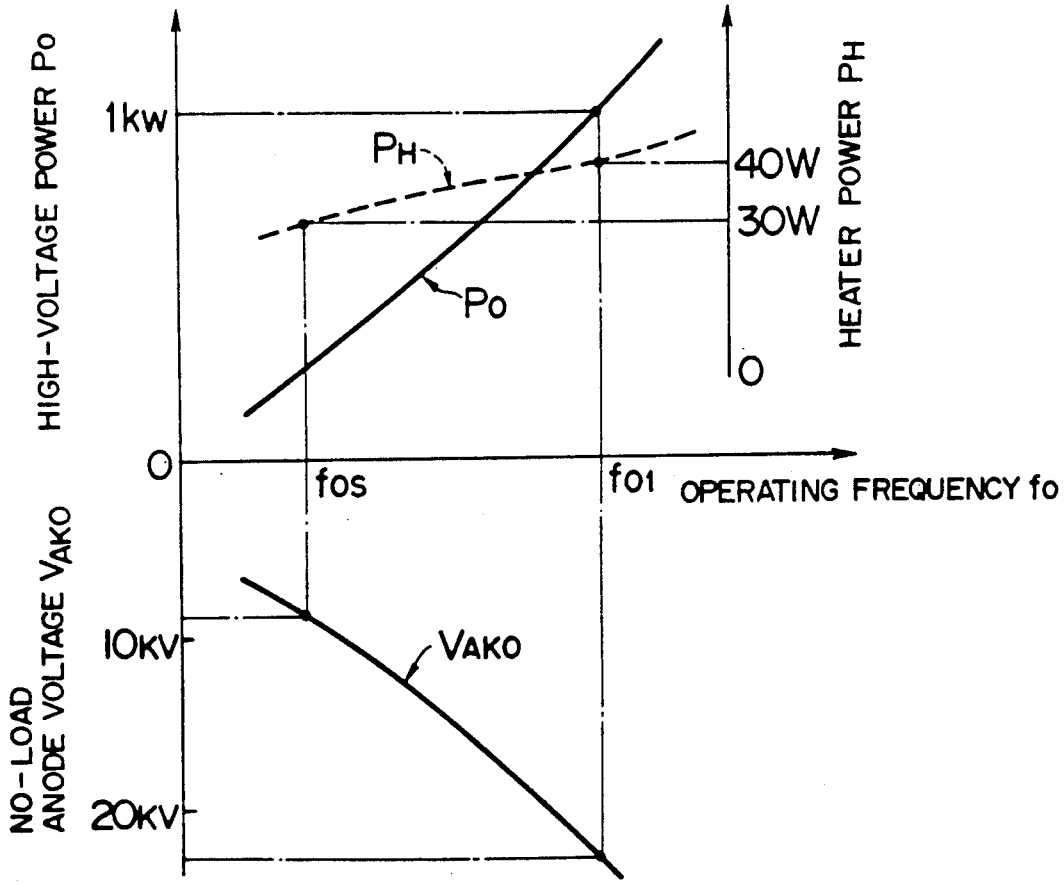
FIG. 2 PRIOR ART
FIG. 2 is a diagram showing characteristics of the prior art circuit of FIG. 1.
Figure 3A:
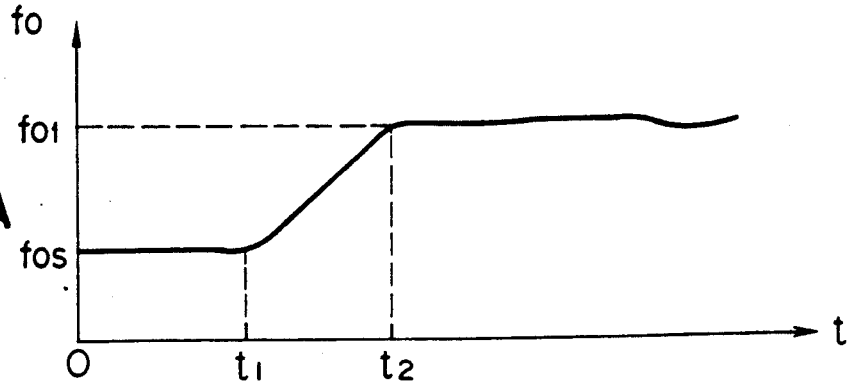
FIG. 3A PRIOR ART
FIGS. 3A-3C are diagrams showing waveforms produced at various parts during operation of the prior art circuit.
Figure 3B:
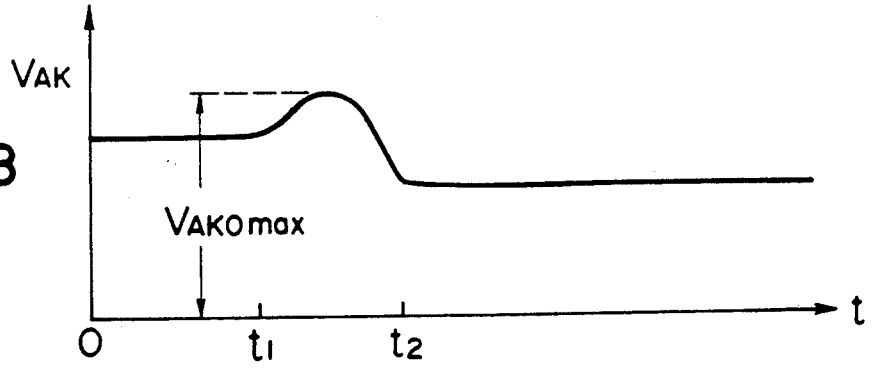
FIG. 3B PRIOR ART
Figure 3C:
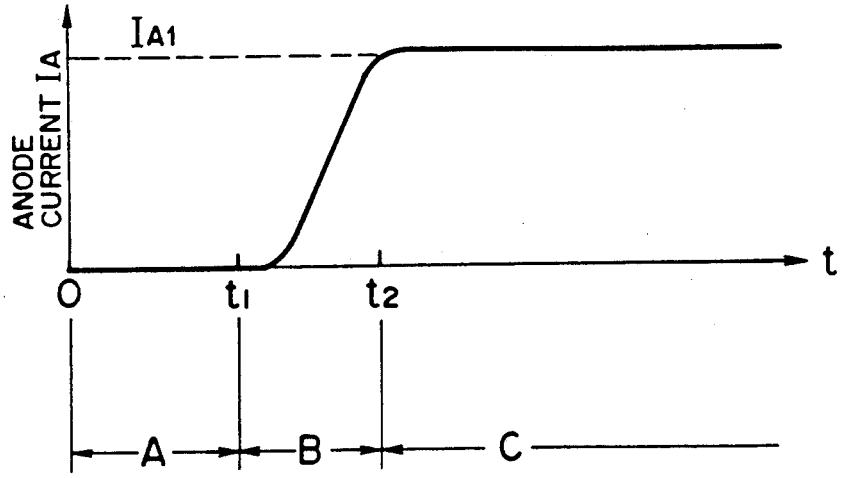
FIG. 3C PRIOR ART
Figure 4:
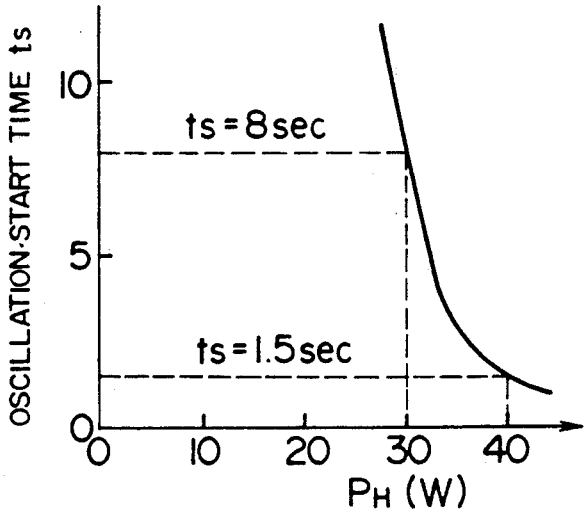
FIG. 4 PRIOR ART
FIG. 4 is a diagram showing a characteristic of a magnetron according to the prior art.
Figure 5A:
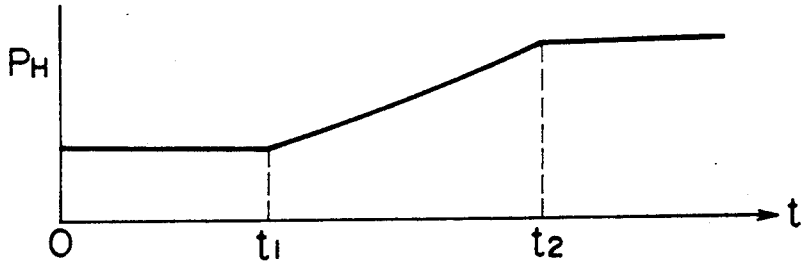
FIG. 5A PRIOR ART
FIGS. 5A to 5C are diagram showing waveforms for illustrating the characteristics of the same magnetron.
Figure 5B:
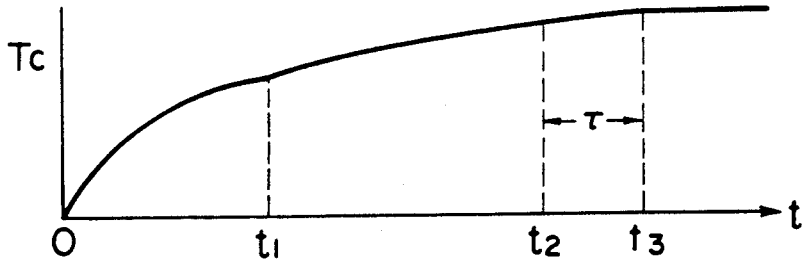
FIG. 5B PRIOR ART
Figure 5C:
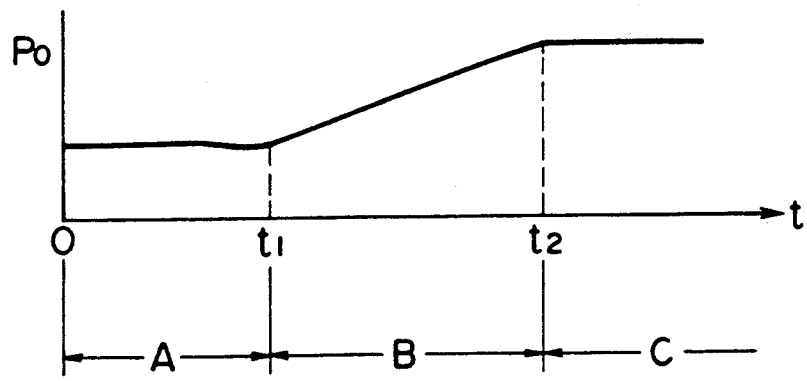
FIG. 5C PRIOR ART
Figure 6:
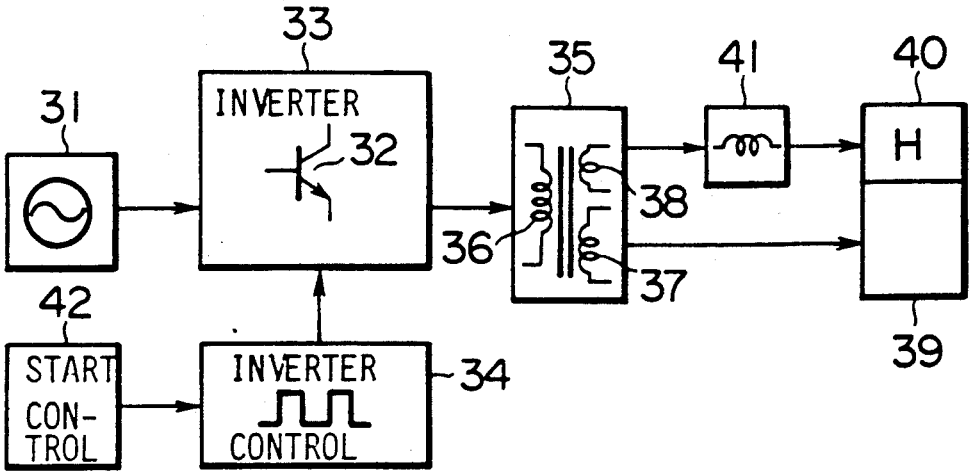
FIG. 6 is a block diagram of a high-frequency heating apparatus according to an embodiment of the present invention.

A block diagram of a high-frequency heating apparatus according to the present invention is shown in FIG. 6. In FIG. 6, a power supply 31 is a unidirectional power supply of a direct current or a pulsating voltage obtained from a battery or a commercial power supply for supplying power to an inverter 33 including a resonant capacitor and one or a plurality of semiconductor switches such as transistors. Inverter control means 34 operates the semiconductor switch 32 with a predetermined conduction time and a non-conduction time substantially equal to the resonance period of the resonant capacitor and a boosting transformer 35 thereby to supply high-frequency power to the primary winding 36 of the boosting transformer 35. As a result, high-voltage power $P_0$ and heater power $P_H$ are generated in the high-voltage secondary winding 37 of the boosting transformer 35 and the heating winding 38, both of which powers are respectively supplied to the anode-cathode circuit of the magnetron 39 and a cathode heater 40.

The cathode heater (that is, a cathode) is connected in series with inductance means 41, so that the load of the heater winding 38 is made up of a series circuit including the inductance means 41 and the cathode heater 40.

Start control means 42 is for giving a modulation command to the inverter control means 34 at the time of starting the inverter 33. In response to this modulation command, the inverter control means 34 controls the conduction time of the semiconductor switch 32 during the starting operation at a value smaller than under a normal condition, while at the same time increasing the non-conduction time to a value longer than under the normal condition to a length substantially equal to an integral multiple of the resonance period, so that the semiconductor switch is turned on when the terminal voltage thereof is a minimum. In this way, the output voltage of the inverter 33 is reduced while reducing the switching loss of the semiconductor switch, and at the same time, the operation period is controlled to a length substantially equal to or longer than under a normal condition, thereby preventing the impedance of the inductance means 41 from increasing. The current flowing in the cathode heater 40 is thus substantially controlled at a proper value equal to or larger than the current under a normal condition.

This configuration prevents the voltage generated in the high-voltage secondary winding 37 from increasing abnormally, and is capable of supplying a heater current (that is, heater power $P_H$) that can assure a stable, superior operation of the cathode heater 40. Further, the loss of the semiconductor switch is kept low. As a consequence, a complicated resonance circuit is not required in the heater circuit, and the oscillation start time of the magnetron 39 is sufficiently reduced, thereby making possible a speedy start of dielectric heating. Also, a condition liable to cause emission shortage of the cathode is prevented from occurring thereby to assure a long service life and high reliability. At the same time, the small loss of the semiconductor switch makes it possible to provide a high-frequency heating apparatus that realizes high reliability and a low cost.

Figure 7:
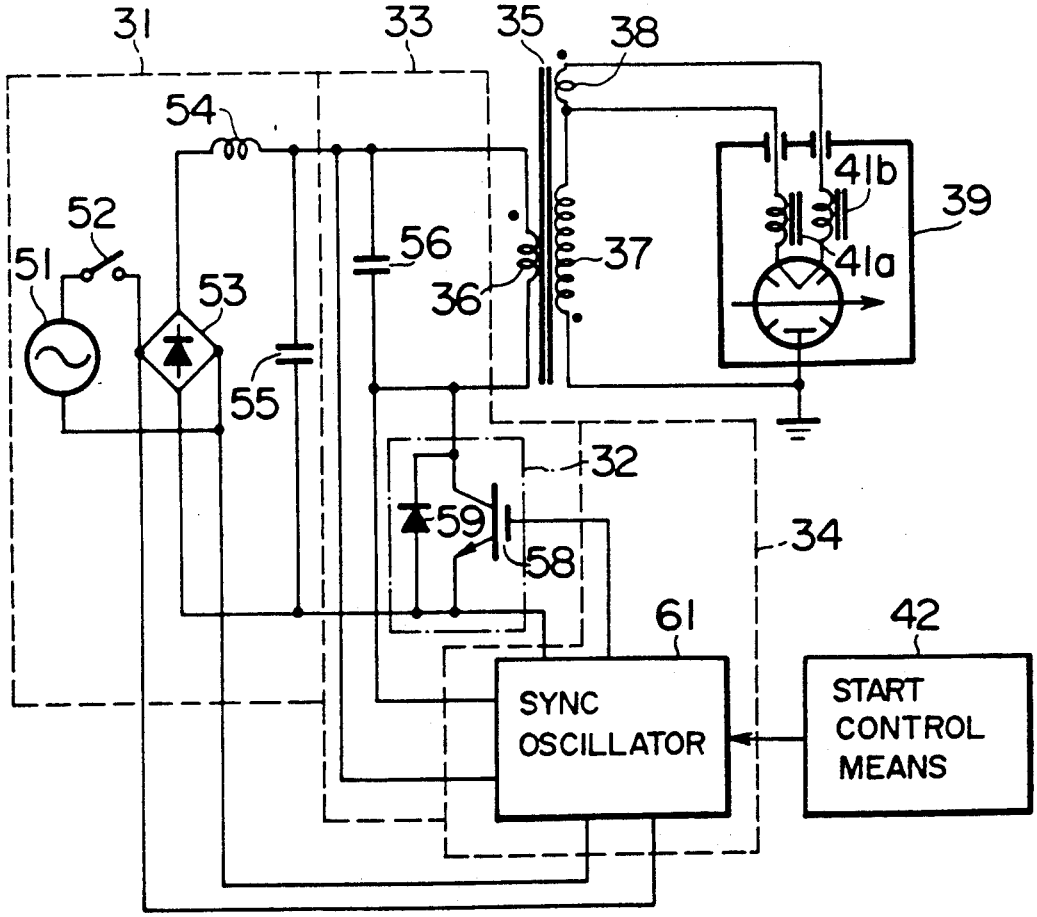
FIG. 7 is a circuit diagram of the same apparatus.

FIG. 7 is a circuit diagram showing the high-frequency heating apparatus more in detail according to an embodiment of the present invention. Those component parts corresponding to those in FIG. 6 are designated with the same reference numerals as in FIG. 6 and will not be described any further.

In FIG. 7, a commercial power supply 51 is connected through an operation switch 52 to a diode bridge 53 and also to inverter control means 34. When the operation switch 52 is turned on, unidirectional power is supplied to the inverter 33 through the capacitor 55 while at the same time energizing the inverter control means 34 and the start control means 42.

The inverter 33 includes a resonance capacitor 56 and a composite semiconductor switch 32 having a bipolar MOSFET (hereinafter referred to as MBT) 58 and a diode 59. The conduction time and the non-conduction time of the inverter 33 are controlled by a sync oscillator 61 of the inverter control means 34.

The start control means 42 is for giving a modulation command to the operation of the sync oscillator 61 of the inverter control means 34 for a predetermined length of time when the operation switch 52 is turned on.

Now, the operation of the embodiment shown in FIG. 7 will be explained with reference to FIG. 8.

FIGS. 8A, 8B, 8C, 8D and 8E are diagrams showing waveforms of the current $I_{c/d}$ flowing in the composite semiconductor switch, the terminal voltage applied thereto, the control voltage $V_G$ applied to the gate of the MBT 58, the anode-cathode voltage $V_{AK}$ of the magnetron 39 and an anode current $I_A$.

The sync oscillator 61 is so configured as to detect a point P in FIG. 8B, that is, a point where the voltage $V_{CC}$ of the capacitor 55 crosses the terminal voltage $V_{CE}$ of the composite semiconductor switch 32 and, a predetermined time Td later, to apply $V_G$ to the MBT 58. The oscillator 61 is thus adapted to turn on the MBT 58 in synchronism with the timing when the voltage $V_{CE}$ generated by the resonance of the resonance capacitor 56 and the primary winding 36 of the boosting transformer 35 is reduced to zero (synchronous control). Since the MBT 58 is turned on when the resonance voltage is substantially zero, the switching loss is greatly reduced. A detailed explanation of the timing for controlling the MBT 58, which will be made later with reference to FIG. 11, will be omitted here. The output of the inverter 33 is capable of being regulated by controlling the ratio between the conduction time $T_{on}$ and the non-conduction time $T_{off}$ of the MBT 58. The value $T_{off}$ is actually determined by the circuit constant of the resonance circuit as a result of the above-mentioned sync control (that is to say, the time $T_{off}$ takes a value in proximity to the resonance period of the resonance circuit), and therefore it is possible to regulate the output of the inverter 33 by controlling the time $T_{on}$.

Figure 8D:
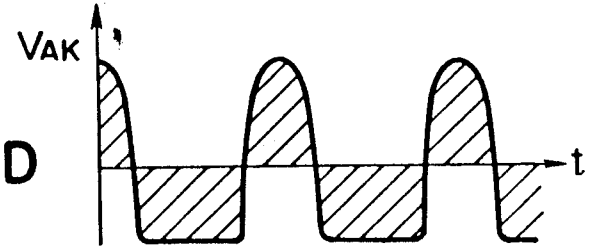
FIGS. 8A to 8G are diagrams showing waveforms of various parts in operation of the same circuit.
Figure 8E:
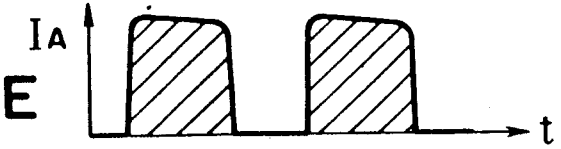
Figure 8F:
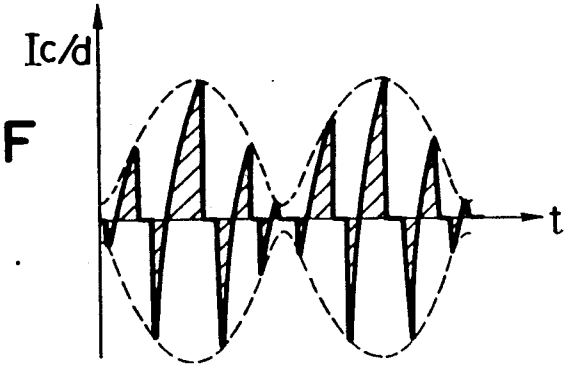
Figure 8G:
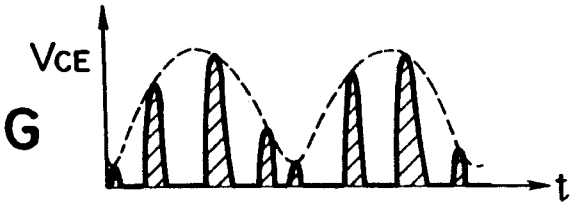
Figure 8A:
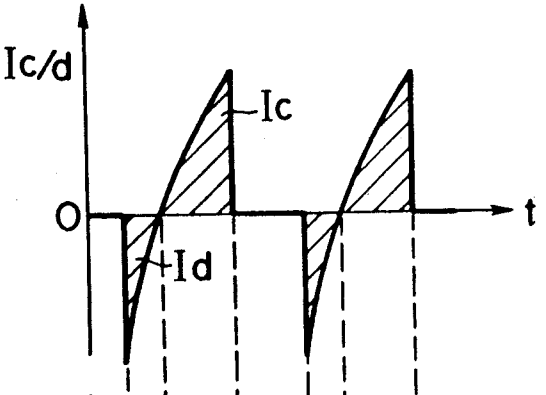
Figure 8B:
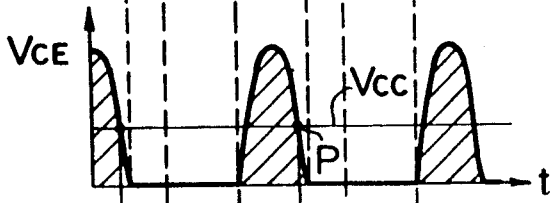
Figure 8C:
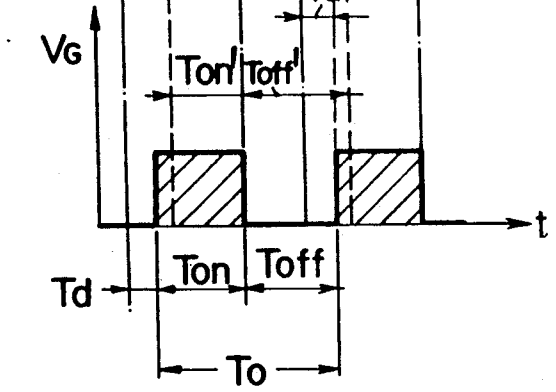

Since the voltage of the capacitor 55 is a pulsating voltage, the current $I_{c/d}$ and voltage $V_{CE}$ in FIG. 8A and FIG. 8B take waveforms having an envelope as shown by dotted lines in FIGS. 8F and 8G.

In this way, the inverter 33 performs the sync oscillation operation by sync control under a normal condition. The sync oscillator 61, however, performs a modulating operation as described below in response to a modulation command of the start control means 42 for a predetermined length of time (such as one second or two seconds) at the time of start of the inverter 33.

Figures 9A, 9B, 9C, 9D, 9E, 9F:
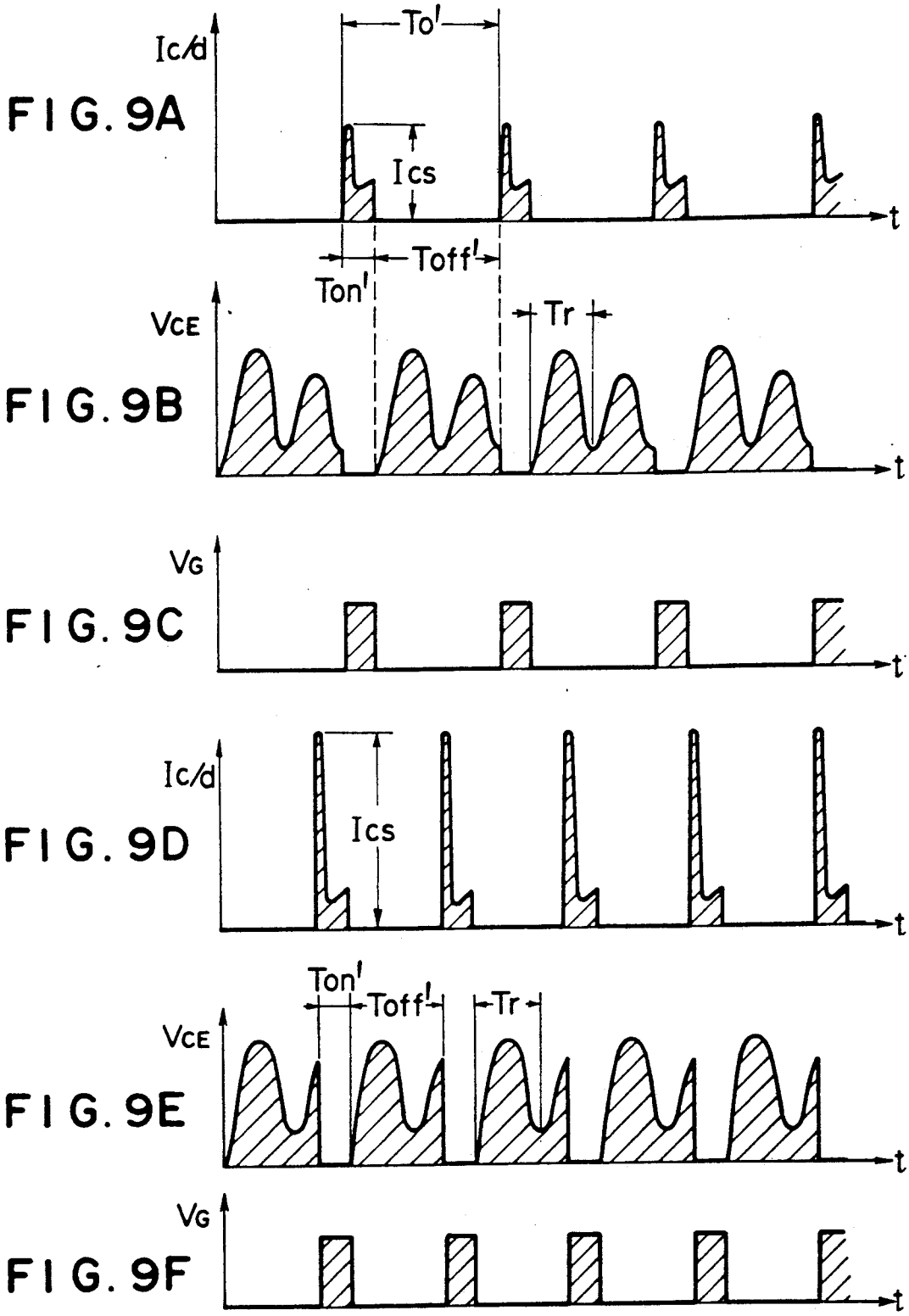
FIGS. 9A to 9F are diagrams showing waveforms produced at various parts in operation at the time of starting of the same circuit.

FIGS. 9A, 9B and 9C show waveforms of $I_{c/d}$, $V_{CE}$ and $V_G$ produced at the time of such a modulating operation. Unlike in the case of FIGS. 8A, 8B and 8C, the sync control in synchronism with unit (one) times the resonance period of the resonance circuit is not effected. Specifically, in FIG. 8B, the waveform of the resonance operation that appears as a waveform of $V_{CE}$ is similar to one times the resonance period of the resonance circuit, in synchronism with which the MBT 58 is subjected to on-off control. In spite of this, the non-conduction time $T_{off}$, which is an integral multiple of twice the resonance period $T_r$ of the resonance circuit is involved for the modulation operation as shown in FIG. 9B. (In FIG. 9B, $T_{off}$, is approximately double the value of $T_r$)

As explained above, the sync oscillation control tracts the resonance operation and may not be effected but as shown in FIG. 9, the value $T_{off}$, may be controlled to a value substantially equal to an integral multiple of $T_r$, whereby the MBT 58 is turned on with a small $V_{CE}$, and the peak current $I_{CS}$ for switching the MBT 58 is kept comparatively small, thus reducing the switching loss.

If $T_{off}$, is displaced from a value proximate to an integral multiple of Tr as shown in FIGS. 9D, 9E or 9F, however, the MBT 58 turns on when $V_{CE}$ takes a large value, and therefore the current $I_{CS}$ assumes a very large value as compared with the case of FIG. 9A. As a result, the switching loss of the MBT 58, becomes extremely large, and the reliability of the MBT 58 is unavoidably reduced on the one hand while a large cooling fan is required for radiation on the other, thereby undesirably leading to a high cost. In the case of FIGS. 9D, 9E and 9F, $T_{off}$, is about 1.5 times $T_r$, and therefore the MBT turns on when $V_{CE}$ is maximum.

The conduction time $T_{on}$, of the MBT 58 is thus controlled smaller than $T_{on}$ for a normal operation, and at the same time, the non-conduction time $T_{off}$, is kept larger than $T_{off}$ under a normal operating condition at a value equal to or an integral multiple of the resonance period $T_r$ of the resonance circuit, with the result that the cycle time $T_o$, is controlled at a value substantially equal to or larger than $T_o$ under a normal operation.

As a consequence, the MBT 58 turns on when the terminal $V_{CE}$ thereof is minimum, thereby keeping the switching loss at a small level, and $T_o$ may be controlled to a value equal to $T_{o'}$ which is longer than $T_o$ at the time of starting the inverter. Thus the high voltage generated in the secondary winding 37 of the boosting transformer 35 is dampened while at the same time controlling the heater current supplied from the heater winding to the cathode of the magnetron 39 at a value equal to or higher than under a normal condition.

The values $T_{on'}$, $T_{on}$, $T_{off}$, $T_{off}$, $T_o$ and $T_{o'}$ may be determined appropriately depending on the values of the ratio of the impedance of the inductance means 41*a* and 41*b* inserted in the heater circuit of the magnetron 39 to the impedance of the cathode heater, the self inductance and mutual inductance of the three windings of the boosting transformer 35 and the resonance capacitor 56.

An example is described now. As shown in FIG. 7, the inductance means 41*a* and 41*b* of the heater circuit are so constructed as to also serve as a choke coil making up a TV noise-dampening filter for the magnetron. The inductance of the inductance means is thus selected at about 1.8 μH respectively. Also, the impedance of the cathode heater is preferably in the range of the value of about 0.3 ohm.

An experiment conducted by the inventors using a magnetron satisfying such conditions as mentioned above and a boosting transformer of an appropriate constant together with a resonance capacitor shows that if the sync oscillator 61 performs a modulating operation initiated by the start control means 42 in the manner mentioned below, it is possible to maintain the anode-cathode voltage $V_{AKC}$ below 10 KV at the time of starting while at the same time increasing the starting heater current $I_H$, to be larger than the value $I_H$ under a normal condition.

Specifically, $T_o=40$ μS, $T_{on}=29$ μS and $T_{off}=11$ μS are modulated to $T_{o'}=63$ μS, $T_{on'}=8$ μS and $T_{off}=55$ μS, respectively, thereby to realize $I_{H'}=12$ A for $I_H=10.5$ A, and hence an extremely stable starting process. At the same time, the average loss of the MBT 55 during modulation is reduced to less than about 50 W. This reduction in average loss is, for example, about 60% of the average loss of about 80 W for 1.5 times the resonance period Tr.

The starting heater power $P_{H'}$ is thus increased by 1.3 times as indicated by $P_{H'}/P_H=(12\ A/10.5A)^2\simeq 1.3$ as compared with the value $P_H$ for a normal operation, thus making possible rapid heating of the heater. In addition, an excessive loss of the MBT is prevented, thereby assuring high reliability without using any large heat radiation fin.

FIG. 10 is a diagram showing the above-mentioned conditions for starting, in which FIGS. 10A to 10F show the manner in which the operating frequency $f_0$ $(=1/T_o)$, $T_{on}$, $T_{off}$, $I_H$, $V_{AK}$ and $I_A$ of the inverter undergo a change from starting to a normal steady operation.

During the period of $t_S$ of 1.5 seconds when $T_{on}$ and $T_{off}$ are controlled to $T_{on'}$ and $T_{off'}$ respectively by the start control means 42, the inverter output is held low, and in spite of the voltage $V_{AKO}$ being limited to 8 KV, the current $I_H$, is controlled to 12 A which is larger than $I_H$ of 10.5 A for a normal operation.

By this control operation, speedy oscillation start of the magnetron is realized while preventing generation of an abnormally high voltage without configurating any complicated resonance circuit in the heater circuit which requires a high potential. Further, by preventing any emission shortage of the cathode, a high-frequency heating apparatus is realized which has very high reliability. Furthermore, the increase in the loss of MBT 58 which is likely to occur in the process is kept small and thus high reliability is assured without any bulky cooling unit.

Figure 11:
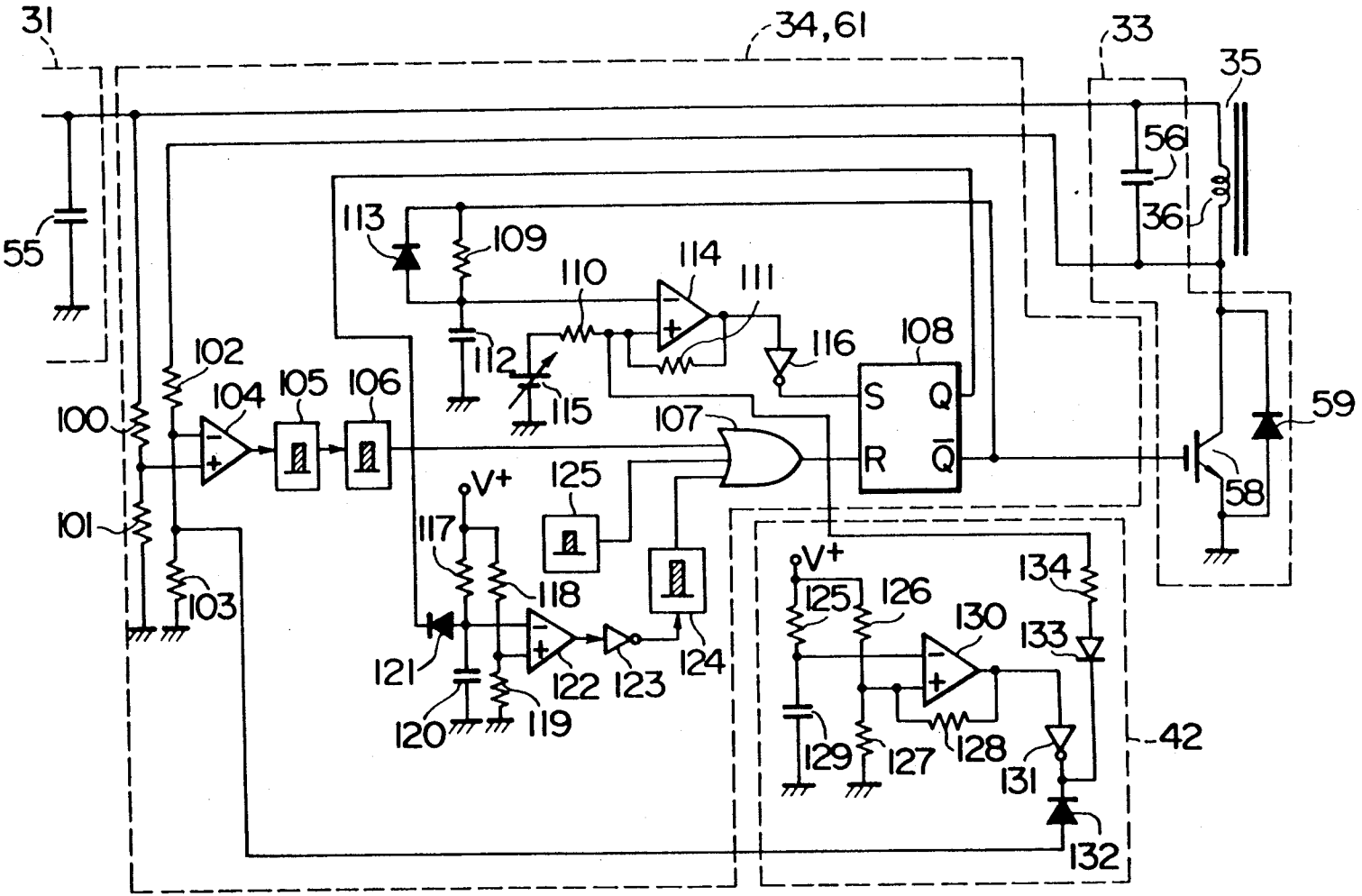
FIG. 11 is a circuit diagram of inverter control means and starting control means of the same circuit.

FIG. 11 is a circuit diagram showing the inverter control means 34 and the start control means 42 of FIG. 7 in greater detail. In FIG. 11, the parts designated by the same reference numerals as in FIG. 7 indicate component parts having corresponding functions and will not be described here. FIG. 11 illustrates a specific example of a configuration of the sync oscillator 61 of the inverter control means 34 and the start control means 42. In order to produce the sync signal shown in FIG. 8B, a voltage $V_{CC}$ of the capacitor 55 and the collector voltage of the MBT 58 are detected by a comparator 104 as voltages divided by resistors 100, 101 and 102, 103 respectively. The rising output of the comparator 104 is converted into a pulse signal in a delay circuit 105 and a differentiation circuit 106, and resets an RS-FF 108 through an OR circuit 107. The $\overline{Q}$ output of the RS-FF is used to drive the gate of the MBT 58, while at the same time starting an on-timer for determining the time $T_{on}$. The on-timer is comprised of resistors 109 to 111, a capacitor 112, a diode 113, a comparator 114 and a reference voltage source 115. Numeral 116 designates an inverter buffer through which an output of the comparator 114 is applied to the S input terminal of the RS-FF. As a result, the FF is set so that $\overline{Q}$ becomes Lo after the lapse of the time $T_{on}$ determined by the reference voltage source 115.

The output Q of the FF is adapted to start an off-timer including resistors 117 to 119, a capacitor 120, a diode 121 and a comparator 122 and determines the maximum value of the time $T_{off}$. More specifically, an output of the comparator 122 is supplied through an inverter buffer 123 and a differentiation circuit 124 to the OR circuit 107. In the case where a sync signal fails to be detected by the comparator 104 after the lapse of a predetermined time length following the time point when Q becomes Hi (that is, when the MOS FET 58 turns off with $\overline{Q}$ at Lo), the RS-FF is forcibly reset to cause $\overline{Q}$ to become Hi. If the value $T_{off}$ determined by the off-timer is set to a value proximate to an integral multiple of the resonance period of the resonance circuit, it is possible to turn on the MBT 58 when $V_{CK}$ is comparatively small as shown in FIG. 9B. Numeral 125 designates a start circuit which is energized by resetting the RS-FF with one pulse applied to the OR circuit 107 when the inverter is started.

During a normal operation of the inverter 33, a sync pulse is applied to the RS-FF from the comparator 104, and due to the resultant sync oscillation, the inverter produces the operation waveforms shown in FIG. 8.

When the inverter is started, the sync oscillation is prevented and controlled at a sync oscillation by the start control means 42 including resistors 125 to 128, a capacitor 129, a comparator 130, an inverter buffer 131, diodes 132, 133 and a resistor 134. At the same time, the time $T_{on}$ is controlled at value smaller than under a normal operation.

Figure 10A:
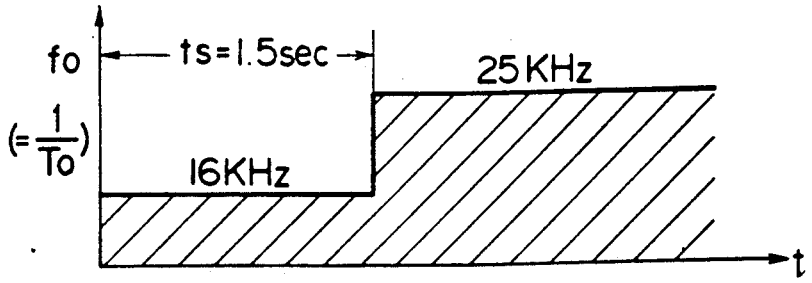
FIGS. 10A to 10F show waveforms illustrating changes in various parameters of the same circuit at the time of starting.
Figure 10B:
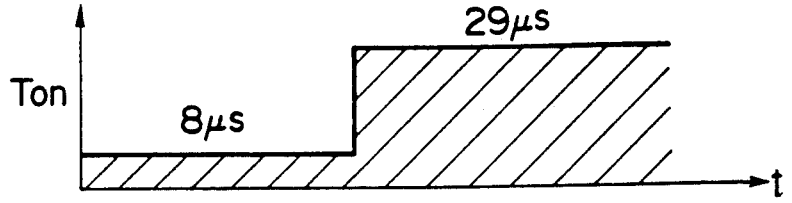
Figure 10C:
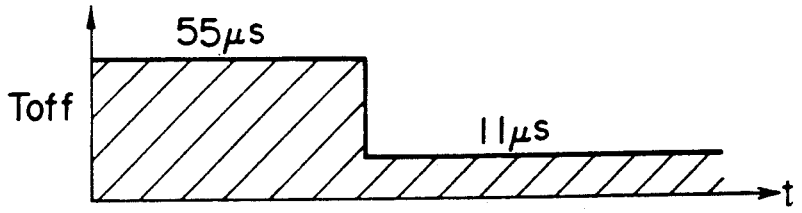
Figure 10D:
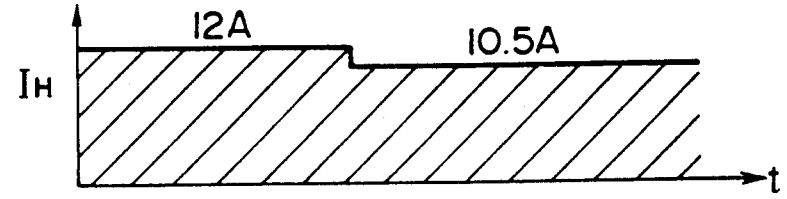
Figure 10E:
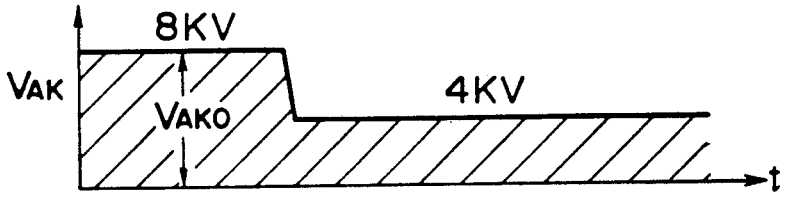

Specifically, when the inverter is started, the output of the comparator remains Hi for a predetermined length of time $t_S$ (1.5 seconds), and therefore the resistor 103 is substantially shorted, and the comparator 104 is prevented from detecting the sync signal. For this reason, the inverter becomes asynchronous, so that the non-conduction time $T_{off}$ of the MBT 58 is determined by the off-timer including the comparator 122, etc. If this off time is set to 55 μS, for instance, the condition shown in FIG. 10C is realized.

Further, at the same time, output of the comparator 130 operates to apply a voltage, which is obtained by dividing the voltage of the reference voltage source 115 by the resistors 110 and 134, to an input to the comparator 114. As a result, the time $T_{on}$ during the period $t_S$ is smaller than under a normal condition, since the set time of the on-timer is small, and therefore the condition of FIG. 10B is realized by setting the on-timer to, say, 8 μS.

The inverter control means is of the sync oscillation type having a timer and limiting the non-conduction time is constructed as described above in such a way that a sync signal is interrupted for a predetermined length of time $t_S$ at the time of starting the inverter while at the same time controlling the time $T_{on}$ to be smaller than that under normal condition. And the non-conduction time is rendered to coincide substantially with an integral multiple of the resonance period of the resonance circuit, whereby the loss of the semiconductor switch is kept low and thus high reliability is assured without using any bulky cooling configuration. In this way, the inconveniences of the prior art are overcome, and the complicated resonance circuit is eliminated from the heater circuit, thereby realizing a high-frequency heating apparatus that can assure high reliability as well as rapid start of magnetron operation.

Figure 12:
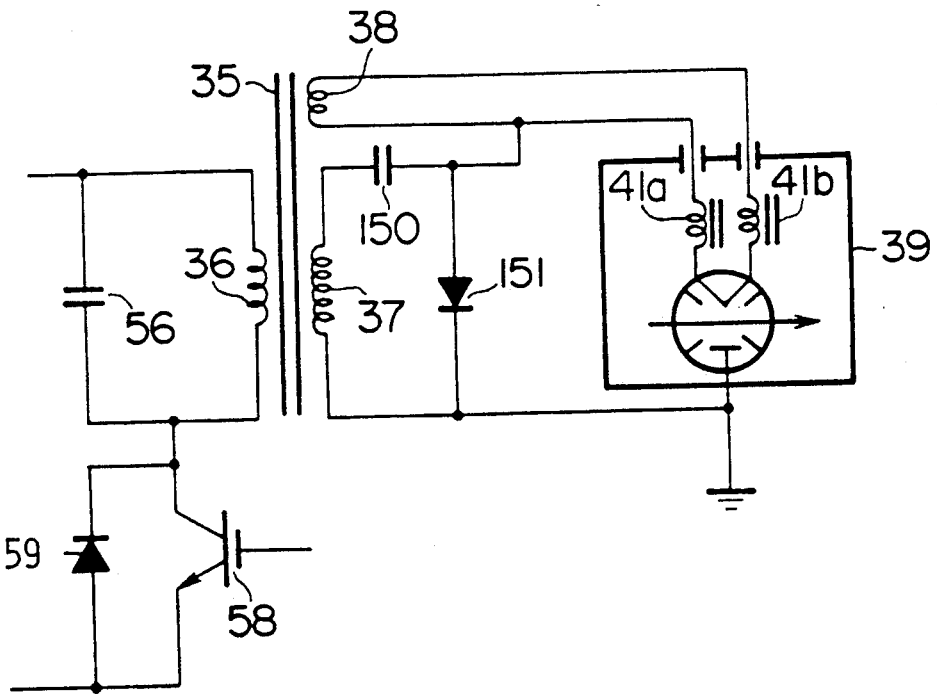
FIG. 12 is a diagram showing a part of the circuit of a high-frequency heating apparatus according to another embodiment of the present invention.

FIG. 12 is a diagram showing a circuit of a high-frequency heating apparatus according to another embodiment of the present invention. This circuit configuration is a modification of the configuration of the high-voltage secondary circuit of the embodiment shown in FIG. 7. In FIG. 12, a high-voltage secondary winding 37 of a boosting transformer 35 is connected with a high-voltage capacitor 150 and a diode 151 thereby to make up a multiple voltage rectifier circuit.

In this configuration, the self inductance and mutual inductance of the primary winding 36 of the boosting transformer 35, the high-voltage secondary winding 37 and heater winding 38 and the resonance capacitor 56 are set to appropriate values respectively in design thereby to attain substantially the same functions and effects as in the aforementioned embodiments.

FIG. 13 shows waveforms of $I_{c/d}$ and $V_{CE}$ at the time of a normal steady operation and starting with the circuit of FIG. 12. FIGS. 13A and 13B show $I_{c/d}$ and $V_{CE}$ for a normal condition, in which $T_o$, $T_{on}$ and $T_{off}$ take values of about 45 μS, 30 μS and 15 μS respectively. Under this normal condition, the conduction time of the MBT 58 is controlled at $T_{on}$, as shown in FIG. 13C, and $I_{c/d}$ and $V_{CE}$ assume waveforms shown in FIGS. 13C and 13D respectively, thereby performing the repetitive operation at time intervals of $T_{o'}$, $T_{on'}$ and $T_{off'}$, which respectively assume values of about 42 μS, 20 μS and 22 μS in the process.

Figure 13A:
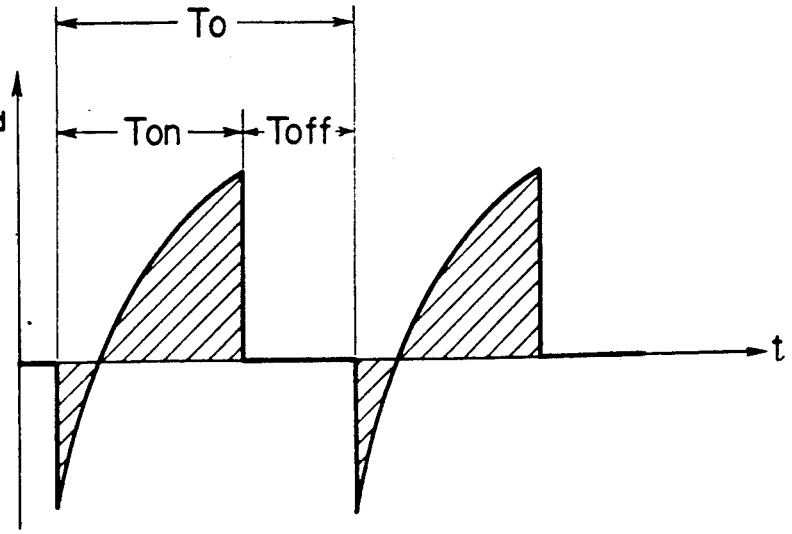
FIGS. 13A to 13D are diagrams showing voltage and current waveforms for explaining the operation of the same circuit.
Figure 13B:
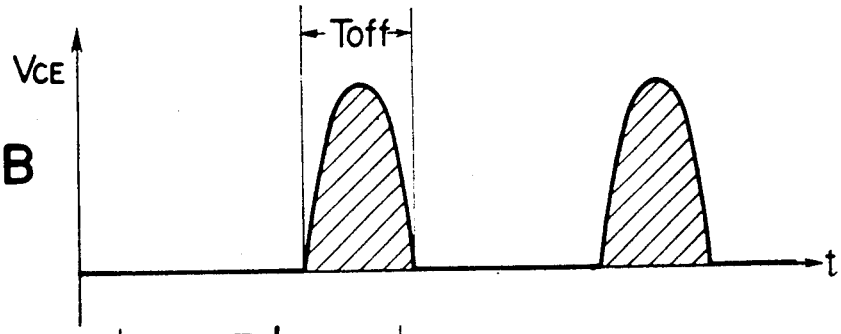
Figure 13C:
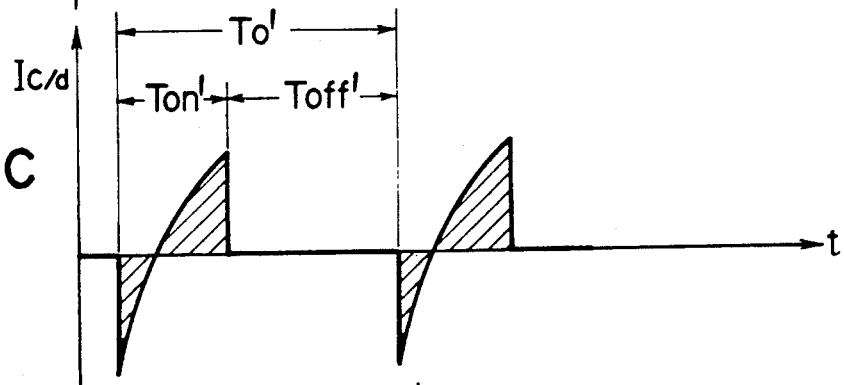
Figure 13D:
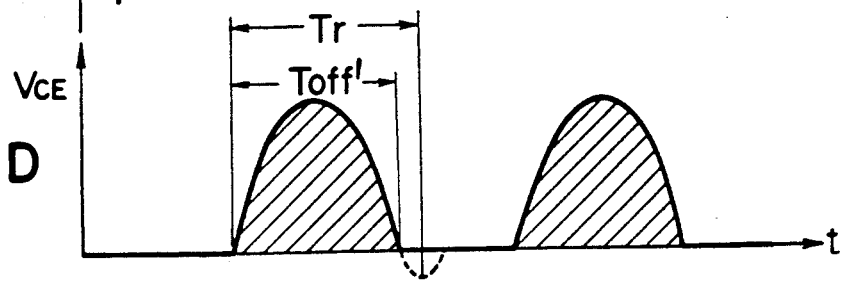

As a result of measuring the heater current $I_H$ supplied to the magnetron 39 in this case, it was found that the heater current may be regulated to 10 A for a normal operation and 12 A for starting operation on condition that the value $V_{AKO}$ is kept at 7 KV. Specifically, by appropriately selecting the constants of the boosting transformer 35 and the resonant capacitor 56, the resonance waveform of $V_{CE}$ for starting time (that is, the time of non-oscillation of the magnetron) can be made to have a low frequency resonance waveform as compared with a normal condition. In starting, therefore, as shown in FIG. 13D, the non-conduction time $T_{off'}$ can be controlled at a value about one time the resonance period Tr of the resonance circuit thereby making the repetitive period or cycle time $T_{o'}$ have a length substantially equal to $T_o$. As a result, it is possible to supply a heater current $I_H$ larger than under a normal condition to the magnetron without generating an excessively high voltage $V_{AKO}$ at the time of starting, thus providing a high-frequency heating apparatus with a magnetron of which a rapid actuation and high reliability are assured without using any complicated resonance circuit in the heater circuit. In this case, the setting of the off-timer including the comparator 122 shown in FIG. 11 at its center, may cause $T_{off}$ to be substantially equal to the starting resonance period Tr shown in FIG. 13D, or the diode 132 may be removed for effecting a sync oscillation control using the comparator 104.

Figure 10F:
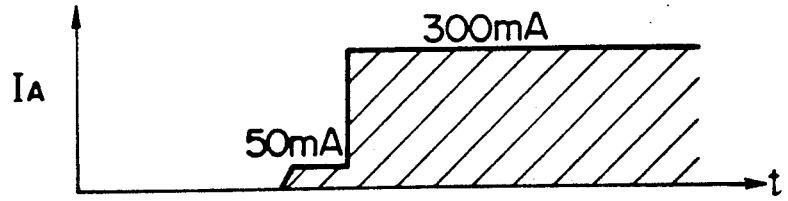

The start control means 42 shown in FIG. 11 is a simple timer circuit with the starting modulation time thereof determined simply by the time such as 1.5 seconds. This start control means 42, however, may be alternatively constructed for improved performance as to detect when the cathode of the magnetron 39 has been sufficiently heated and has started oscillation. For instance, a change in the anode-cathode voltage $V_{AK}$ of the magnetron 39 from $V_{AKO}$=7 to 8 KV for non-oscillation to $V_{AK}$=4 KV for oscillation or the beginning of a slight flow of the anode current $I_A$ as shown in FIG. 10F may be detected.

Figure 14:
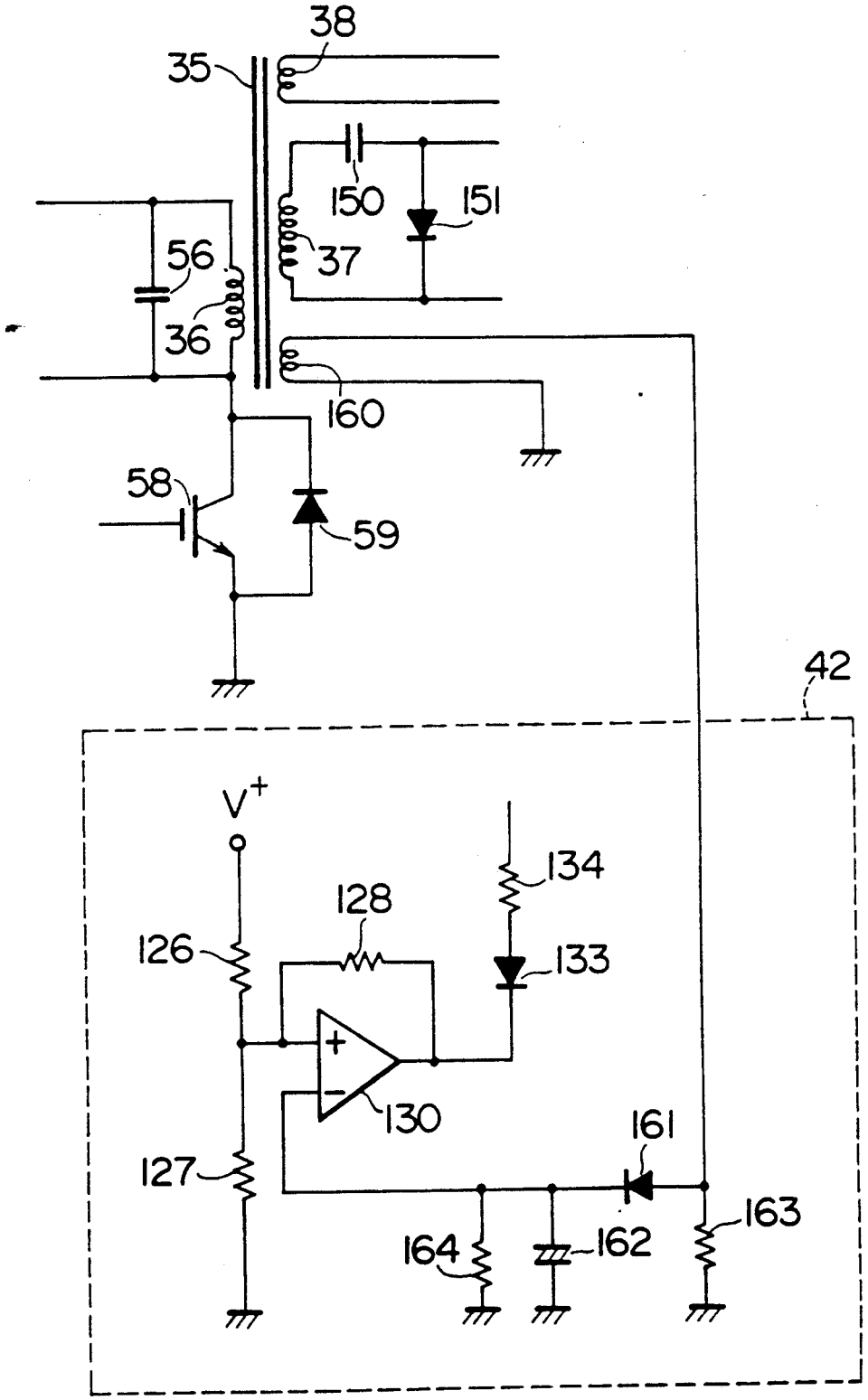
FIG. 14 is a circuit diagram illustrating another embodiment of the starting control means.

In other words, by constructing the start control means 42 as shown in FIG. 14, it is possible to detect the start of an oscillation of the magnetron 39 as mentioned above from the decrease in the voltage $V_{AK}$ (from 7 KV to 4 KV).

In FIG. 14, the boosting transformer 35 has an output voltage detection winding 160 for detecting the magnitude of the voltage $V_{AK}$, an output signal of which is converted into a DC voltage through a diode 161, a capacitor 162, and resistors 163, 164 and supplied to a comparator 130. When the magnetron 39 oscillates and the voltage $V_{AK}$ drops with the terminal voltage of the resistor 164 lowering from a reference voltage determined by the resistors 126, 127 and 128, the output of the comparator 130 becomes "High". As a result, the positive input voltage of the comparator 114 in FIG. 11 also increases and becomes equal to the reference voltage, so that the conduction time of the MBT 58 becomes as long as a normal conduction time.

In this way, the start control means 42 is provided with means for detecting a change in the condition of the magnetron 39, the inverter 33 or the boosting transformer 35 in some form or other, and thus switching the conduction time of the MBT 58. Thus it is possible to control the starting modulation in accordance with the rate of temperature increase of the cathode of the magnetron 39, thereby permitting the operation of the magnetron 39 always at a maximum output in the shortest length of time.

It will thus be understood from the foregoing description that according to the present invention, an output of an inverter is supplied to the anode-cathode circuit and a cathode heater of the magnetron through a boosting transformer, an inductance means is connected in series with the cathode heater, and a start control means is inserted for giving a modulation command at the time of starting the inverter. In response to this modulation command, the inverter control means reduces the conduction time of a semiconductor switch to a value smaller than that under a normal condition, while at the same time increasing the non-conduction time by an almost integral multiple of the resonance period of a resonance circuit, whereby the operating period of the inverter becomes substantially equal to or longer than that under a normal condition. As a result, an abnormally high voltage is prevented from being generated at the time of starting without the need of any complicated resonance circuit in the heater circuit producing a high potential on the one hand and keeping the loss of the semiconductor switch to a low level on the other. In addition, a rapid start of oscillation of the magnetron is realized. Further, the cathode is preheated sufficiently at the time of starting, and therefore any phenomenon of emission shortage of the cathode and hence the deterioration of the cathode is prevented, thus realizing a high-frequency heating apparatus with high reliability.

We claim:

1. A high-frequency heating apparatus comprising:

power supply means;

an inverter having an operating period and a controllable output with a predetermined rated output level including at least one semiconductor switch for controlling said output and having a selectable duty cycle, said duty cycle being defined as the ratio of the time during which said switch conducts to the sum of the times during which said switch is conducting and non-conducting; and a resonance capacitor;

a boosting transformer forming a resonance circuit with the resonance capacitor, said boosting transformer supplying high-voltage and heater power to a magnetron having a cathode;

inductance means connected in series with the cathode of the magnetron, said inductance means having a predetermined impedance of a value such that said inductance means functions as a noise damping filter and also operates to limit a current flowing through the cathode of the magnetron;

inverter control means including synchronization means, for controlling the duty cycle of the semiconductor switch in synchronism with the resonance period of said resonance circuit; and start control means for supplying a modulation command to the inverter control means at the time of starting the inverter;

said inverter control means being responsive to said modulation command during starting of said inverter for controlling the duty cycle of the semiconductor switch to be lower than that required for said inverter to produce said predetermined rated output level and to become substantially equal to that required for said cathode to be heated to a predetermined temperature, where said non-conduction time of the semiconductor switch is substantially equal to an integral multiple of said resonance period of the resonance circuit, thereby controlling the operating period of said inverter during starting thereof to be longer than when the inverter is operating to produce said predetermined rated output level.

2. A high-frequency heating apparatus according to claim 1, further comprising a voltage double rectifier circuit inserted between the boosting transformer and the magnetron.

3. A high-frequency heating apparatus comprising:

power supply means;

an inverter having an operating period and a controllable output with a predetermined rated output level including at least one semiconductor switch for controlling said output and having a selectable duty cycle, said duty cycle being defined as the ratio of the time during which said switch conducts to the sum of the times during which said switch is conducting and non-conducting; and a resonance capacitor;

a boosting transformer forming a resonance circuit with the resonance capacitor, said boosting transformer supplying high-voltage and heater power to a magnetron having a cathode;

inductance means connected in series with the cathode of the magnetron, the inductance means having a predetermined impedance substantially equal to or larger than that of the cathode of the magnetron when the inverter is operating to produce said predetermined rated output level, and of a value such that said inductance means functions as a noise damping filter and also operates to limit a current flowing through the cathode of the magnetron;

inverter control means including synchronization means, for controlling the duty cycle of the semiconductor switch in synchronism with the resonance period of said resonance circuit; and start control means for supplying a modulation command to the inverter control means at the time of starting the inverter;

said inverter control means being responsive to said modulation command for controlling the duty cycle of the semiconductor switch during starting of said inverter to be lower than that required for said inverter to produce said predetermined rated output level and to become substantially equal to that required for said cathode to be heated to a predetermined temperature, where said non-conduction time of the semiconductor switch is substantially equal to an integral multiple of said resonance period of the resonance circuit, thereby controlling the operating period of said inverter during starting thereof to be longer than when the inverter is operating to produce said predetermined rated output level.

4. A high-frequency heating apparatus according to claim 2, further comprising a voltage doubler rectifier circuit inserted between the boosting transformer and the magnetron.

5. A high-frequency heating apparatus comprising:

power supply means;

an inverter having an operating period and a controllable output with a predetermined rated output level including at least one semiconductor switch for controlling said output and having a selectable duty cycle, said duty cycle being defined as the ratio of the time during which said switch conducts to the sum of the times during which said switch is conducting and non-conducting; and a resonance capacitor;

a boosting transformer forming a resonance circuit with the resonance capacitor, said boosting transformer supplying high-voltage and heater power to a magnetron having a cathode;

inductance means connected in series with the cathode of the magnetron, said inductance means having a predetermined impedance of a value such that said inductance means functions as a noise damping filter and also operates to limit a current flowing through the cathode of the magnetron;

inverter control means including synchronization means for controlling the duty cycle of the semiconductor switch in synchronism with the resonance period of said resonance circuit; and start control means including timer means for supplying a modulation command to the inverter control means during a time period determined by the timer at the time of starting the inverter;

said inverter control means being responsive to said modulation command for controlling the duty cycle of the semiconductor switch during starting of said inverter to be lower than that required for said inverter to produce said predetermined rated output level and to become substantially equal to that required for said cathode to be heated to a predetermined temperature, where said non-conduction time of said semiconductor switch is substantially equal to an integral multiple of said resonance period of the resonance circuit, thereby controlling the operating period of said inverter during starting thereof to be longer than when the inverter is operating to produce said predetermined rated output level.

6. A high-frequency heating apparatus comprising:

power supply means;

an inverter having an operating period and a controllable output with a predetermined rated output level including at least one semiconductor switch for controlling said output and having a selectable duty cycle, said duty cycle being defined as the ratio of the time during which said switch conducts to the sum of the times during which said switch is conducting and non-conducting; and a resonance capacitor;

a boosting transformer forming a resonance circuit with the resonance capacitor, said boosting transformer supplying high-voltage and heating power to a magnetron having a cathode;

inductance means connected in series with the cathode of the magnetron to thereby limit a current flowing through the cathode of the magnetron, said inductance means having a predetermined impedance of a value such that said inductance means functions as a noise damping filter;

inverter control means including synchronization means for controlling the duty cycle of the semiconductor switch in synchronism with the resonance period of said resonance circuit;

means for detecting the initiation of oscillation of said magnetron, and for producing a magnetron initiation status signal; and start control means receiving said magnetron initiation status signal and supplying a modulation command to said inverter control means at the time of starting the inverter during a time period before the oscillation of the magnetron is started, in response to said status signal, said inverter control means being responsive to said modulation command for controlling the duty cycle of the semiconductor switch during starting of said inverter to be lower than that required for said inverter to produce said predetermined rated output level and to become substantially equal to that required for said cathode to be heated to said predetermined temperature, where said non-conduction time is substantially equal to an integral multiple of said resonance period of the resonance circuit, thereby controlling the operating period of said inverter during starting thereof to be longer than when the inverter is operating to produce said predetermined rated output level.

7. A high-frequency heating apparatus comprising:

power supply means;

an inverter having an operating period and producing a controllable output including a predetermined rated output level, said inverter comprising a resonance capacitor; and at least one semiconductor switch for controlling the output of said inverter and having a selectable duty cycle, said duty cycle being defined as the ratio of the time, during which said semiconductor switch conducts, to the sum of the times during which said semiconductor switch is conducting and non-conducting;

a boosting transformer having primary and secondary windings and forming a resonance circuit with said resonance capacitor, said boosting transformer supplying a high voltage to a magnetron and heating power to a cathode of said magnetron;

inductance means connected in series with the cathode of said magnetron, said inductance means having a predetermined impedance of a value such that said inductance means operates to limit a current flowing through the cathode of said magnetron;

inverter control means including synchronization means for controlling the duty cycle of said semiconductor switch in synchronism with a resonance period of said resonance circuit; and start control means for supplying a modulation command to said inverter control means at the time of starting said inverter;

said inverter control means being responsive to said modulation command for controlling the duty cycle of said semiconductor switch during starting of said inverter to be lower than that required for said inverter to produce the predetermined rated output level and to become substantially equal to that required for the cathode to be heated to a predetermined temperature, where the self and mutual inductances of said primary and secondary windings of said boosting transformer and the capacitance of said resonance capacitor are selected so that the resonance period of said resonance circuit is increased when said magnetron is in a non-oscillation state and said semiconductor switch is operating with a duty cycle which is smaller than when said inverter is operating to produce the predetermined output level and thereby the non-conduction time of said semiconductor switch during starting of said inverter is substantially equal to the resonance period of said resonance circuit during starting of said inverter, whereby the operating period of said inverter at the time of starting becomes substantially equal to that when said inverter is operating to produce the predetermined rated output level.

8. A high-frequency heating apparatus according to claim 7, further comprising a voltage doubler rectifier circuit inserted between the boosting transformer and the magnetron.

* * * * *